United States Patent [19]

Blunk

[11] 4,123,005

[45] Oct. 31, 1978

[54] ACOUSTICAL TEXTURE APPLICATOR

[76] Inventor: Glenn I. Blunk, Rte. 1, Box 91, Oklahoma City, Okla. 73111

[21] Appl. No.: 842,774

[22] Filed: Oct. 17, 1977

Related U.S. Application Data

[63] Continuation-in-part of Ser. No. 705,371, Jul. 14, 1976, abandoned.

[51] Int. Cl.[2] ..... B05B 7/14; B65D 1/32

[52] U.S. Cl. ..... 239/327; 222/193; 239/346; 239/434.5

[58] Field of Search ..... 239/310, 311, 318, 323, 239/327, 328, 340, 346, 434, 434.5; 222/206, 207, 215, 193

[56] References Cited

U.S. PATENT DOCUMENTS

| | | | |
|---|---|---|---|
| 311,425 | 1/1885 | Fessy | 239/434 X |
| 1,501,432 | 7/1924 | Bleakley | 239/340 X |
| 2,368,536 | 1/1945 | Gersmehl | 239/434 X |
| 3,052,417 | 9/1962 | Daniel | 239/327 X |
| 3,386,664 | 6/1968 | Knibb | 239/327 X |

FOREIGN PATENT DOCUMENTS

| | | | |
|---|---|---|---|
| 559,900 | 3/1957 | Italy | 239/311 |
| 431,706 | 7/1935 | United Kingdom | 239/318 |

*Primary Examiner*—Evon C. Blunk
*Assistant Examiner*—Andres Kashnikow
*Attorney, Agent, or Firm*—Robert K. Rhea

[57] ABSTRACT

A squeeze-type container device for dispensing viscous acoustical texture material by a spraying action on a wall or ceiling surface. A spray head is attached to the container and connected with a source of air under pressure for spraying the viscous material through an orifice for repairing damaged areas of acoustic texture walls or ceilings.

1 Claim, 1 Drawing Figure

ACOUSTICAL TEXTURE APPLICATOR

CROSS-REFERENCE TO RELATED APPLICATION

This application is a continuation-in-part of an application filed by me in the U.S. Patent and Trademark Office on July. 14, 1976, Ser. No. 705,371 for ACOUSTICAL TEXTURE APPLICATOR, now abandoned.

BACKGROUND OF THE INVENTION

1. Field of the Invention

The present invention relates to liquid dispensing spray guns and more particularly to an acoustic material applicator for repair spraying small areas of damaged walls and ceilings.

It is common practice in building construction to cover wall and ceiling areas with a coat of acoustic material comprising a viscous mixture containing fibrous materials or small particles of expanded synthetic resinous material, such as Styrofoam. During construction this acoustic material is usually applied by a spray gun supplied with the material from a reservoir with air being supplied by a compressor. The equipment is necessarily bulky and is not easily moved from one location to another. After initial application, the acoustic coating is frequently damaged accidently during further construction requiring the damaged area to be repaired. Repairing the damaged area presents a problem not only by necessitating returning the spray equipment to the location to be repaired but principally for the reason the initial applicator gun sprays a relatively large area and is not easily controlled for spraying a small damaged area thus resulting in recovering that area surrounding the damaged surface and a mismatching of the texture or color, if colored, so that the repair job is obvious.

This invention provides a relatively small spray type applicator similarly actuated by a source of air under pressure and is easily controlled to apply a relatively small quantity of the viscous material, The amount of material sprayed on a wall surface being controlled by manual pressure applied to a squeeze-type container so that an excess of the material is not applied indiscriminately to the surface around the area being repaired.

2. Description of the Prior Art

The most pertinent prior patent is believed to be Italian Pat. No. 559,900, issued MAR. 27, 1957 (Grossi). This patent discloses an aspirator for spraying a liquid from an attached container with the liquid flow being controlled by a valve.

The principal distinction of this invention over the above-named patent is the truncated conical configuration of the chamber having its larger end disposed toward an orifice through which an air tube conducts a stream of air. The relationship of the port diameter, admitting the material be be sprayed, to the transverse cross sectional area surrounding the air tube within the truncatcated wall must be on a ratio of at least one-to-one for movement of viscous material to be sprayed.

Other prior patents relating to this invention are U.S. Pat. Nos. 311,425; 1,501,432; 2,368,536; 3,052,417; 3,386,664 and British Pat. No. 431,706 (Lennox) issued JULY. 15, 1935, but not believed to be as pertinent as the Italian patent, generally relate to aspirator type spraying devices some of which employ squeeze-type containers for the purpose of ejecting or spraying discrete portions of fluid on a small area or for painting, cleaning or other types of liquid dispensers. None of these devices, it is believed, are capable of spraying a viscous material, such as acoustic texture material, for the reason acoustic texture material is not easily applied in discrete amounts.

SUMMARY OF THE INVENTION

A generally cylindrical hollow spray head is connected at one end with a hose supplying a stream of pressurized air for axial flow through an orifice at the other end of the head by means of a tube communicating with the air pressure hose and projecting axially through the major portion of the head and terminating in spaced relation with respect to the orifice. The spray head is provided with a lateral threaded port for receiving the neck of a flexible squeeze-type container containing a desired quantity of viscous acoustic wall texture material so that the viscous material may be forced into the air stream assisted by jet action of the air through the head and sprayed on a damaged wall area.

The principal object of this invention is to provide an acoustic wall texture applicator of the air gun type including a spray head formed of separable components for ease in clean-up which is connected with a squeeze-type dispensing container so that the amount of material being sprayed is easily controlled manually.

DESCRIPTION OF THE PREFERRED EMBODIMENT

Figure 1:
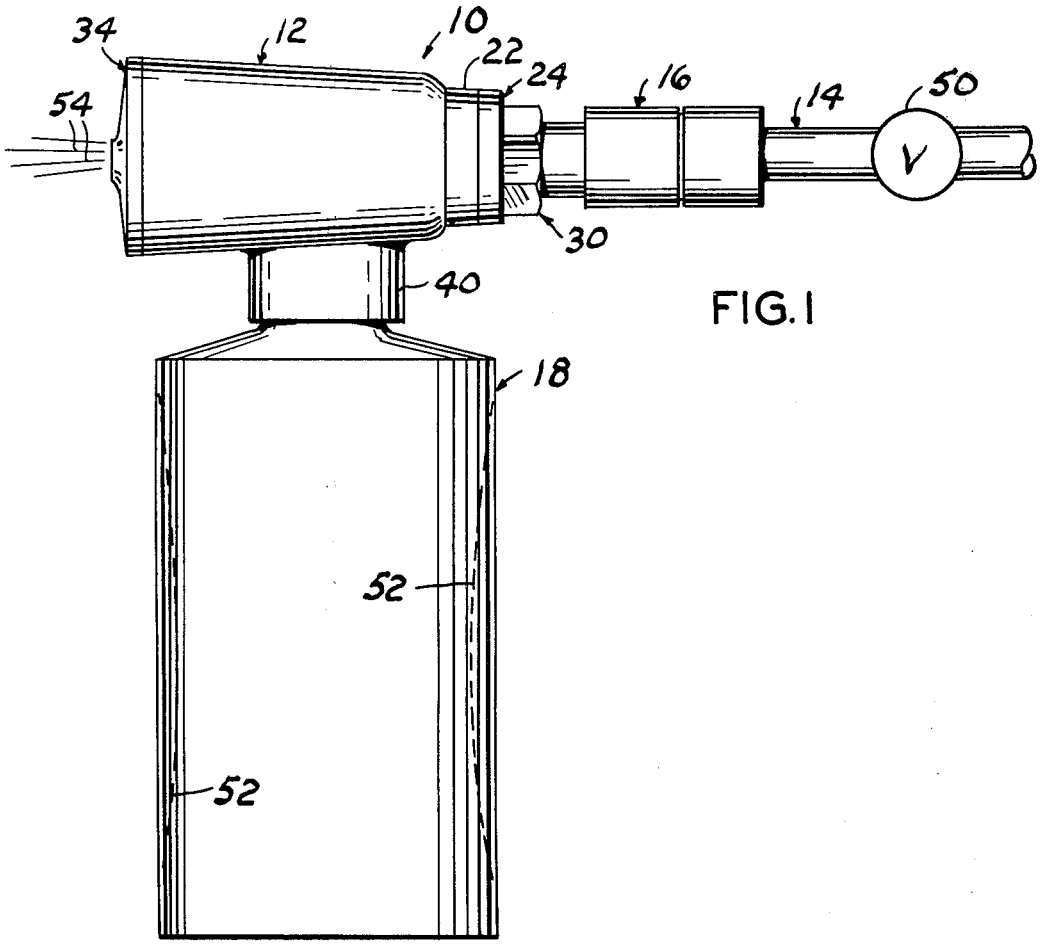
FIG. 1 is a side elevational view of the apparatus connected with a fragment of an air hose; and, FIG. 2 is a vertical cross sectional view of the spray head and a fragment of the container illustrating the head connected with an air hose by dotted lines.
Figure 2:
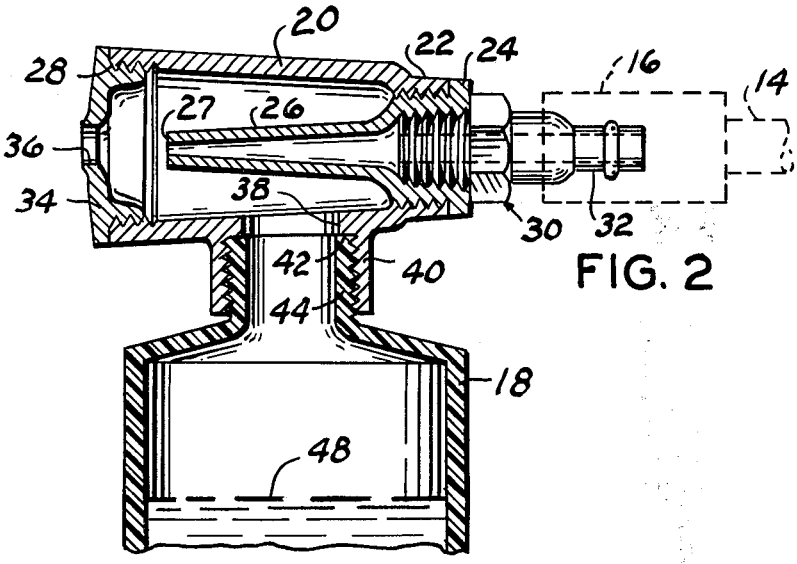

Like characters of reference designate like parts in those FIGS. of the drawings in which they occur.

In the drawings:

The reference numeral 10 indicates the device, as a whole, comprising a spray head 12 connected with an air hose 14 by a quick coupler 16 and a squeeze-bottle type container 18. The spray head 12 is formed by a truncated conical body wall 20 having its smaller internally threaded rearward inlet end portion 22 connected with an air tube 24 having a gradually tapered portion 26 projecting axially toward and terminating in a restricted diameter end 27 adjacent a transverse plane defining the inner limit of internal threads 28 formed in the opposite or forward outlet end portion of the wall 20. The tube 24 is internally threaded at its end connected with the body wall 22 for receiving a tubular air fitting 30 having a reduced diameter end portion 32 adapted for connection with the conventional quick coupler 16 secured to the air pressure supply hose 14. A plug-type end member 34 is threadedly connected with the wall threads 28 and is provided with a dish-shaped recess, having the surface forming its inner limit, facing toward and spaced from the air tube end 27 a distance at least equal to the length of the threads 28. The plug end member 34 is provided with a central orifice 36 coaxially aligned with the air tube 24.

The body wall 20 is provided with a lateral port 38 intermediate its ends diametrically at least equal to the transverse area around the air tube 24 at the inlet end of the body wall and surrounded by an outstanding internally threaded flange 40 to define an annular outwardly facing shoulder 42 for sealing with the neck portion 44 of the flexible wall container 18 when threadedly engaged with the flange threads. The position of the wall opening 38 is rearwardly of the restricted end 27 of the air tube for the purpose of lowering the pressure within the end portion of the head adjacent its air hose connected end and upper end portion of the container to assist in movement of viscous material 48, contained by the container 18, into the head when the container walls are manually squeezed.

The viscous material 48 is normally stored in a dry state and a selected quantity is mixed with water to fill the container 18. The amount of water used is such that the resulting mixture has the consistency approaching that of a mortar mix, such as is used in laying bricks, or the like. Stated another way, the viscosity of the material 48 is such that it will not readily flow, by gravity, when a quantity thereof is disposed on a horizontal surface. Such viscosity requires that the diameter of the lateral port 38 and the cross sectional area of the body wall 28 be sufficiently large to permit movement of the viscous material 48 thereinto. For example, the diameter of the lateral port 38 and the neck opening of the container 18 is preferably seven-eights inch (2¼cm) and the transverse cross sectional area within the wall 20 around the tube 26 in line with the axis of the port 38 is at least equal to and preferably greater than the diameter of the port 38.

OPERATION

In operation a desired quantity of the wall texture material 48 is placed within the container 18 prior to its connection with the spray head 12. The air hose 14, connected with a source of air under pressure, not shown, is connected to the spray head 12 by the quick coupler 16. The operator grasps the container 18 by one hand and substantially inverts the entire unit so that the bottom of the container is disposed upwardly and usually holds the air hose 14 with his other hand for controlling the quantity of air passing through the spray head 12 by an air control valve 50 interposed in the air hose 14. The viscous material 48 is forced into the interior of the spray head by manually squeezing the receptacle walls, such as shown by the dotted lines 52 (FIG. 1), to fill the conical-shaped passageway, formed by the wall 20, and the dish-shaped recess of the end member 34. A small quantity of the viscous material is then blown by the air stream flowing through the air tube 24 and through the orifice 36 aimed at the damaged wall area to be repaired, as indicated by the spray lines 54 (FIG. 1). The operator quickly learns, by trail and error, to regulate the quantity of viscous material 48 applied to a wall surface by manual pressure applied to the container 18. When manual pressure on the container walls is interrupted, the air flowing from the tube end 27 forms a path to the orifice 36 through the viscous material 48 within the end member recess.

Obviously the invention is susceptible to changes or alterations without defeating its practicability. Therefore, I do not wish to be confined to the preferred embodiment shown in the drawings and described herein.

I claim:

1. A viscous texture spray applicator, comprising:

an elongated hollow body of truncated conical form having an internally threaded forward end and a rearward inlet end forming a viscous fluid passageway throughout the major portion of its length tapering outwardly from its inlet end;

an elongated air tube coaxially disposed within said body and connected at one end with the inlet end of said body and being gradually reduced to a restricted extremity at its other end and terminating adjacent the inner limit of the forward end body threads for axially concentrating a stream of air flowing toward the forward end of said body;

a tubular fitting connected with said air tube opposite its restricted extremity and adapted to be connected with a source of air under pressure;

an end member threadedly connected with the forward end of said body, said end member having an axial dish-shaped recess facing toward said air tube diametrically substantially equal with respect to the diameter of the fluid passageway at the forward end of said body and having an orifice coaxially aligned with and spaced forwardly of the restricted extremity of said air tube a distance at least greater than the depth of the recess, said body having a lateral port, diametrically at least equal with respect to the transverse cross sectional area of the fluid passageway surrounding said air tubs at the inlet end of said body, intermediate its ends surrounded by an outstanding flange; and, a flexible wall fluid container having an open neck portion adapted to be secured to said body flange, hereby external pressure continuously applied to opposing exterior surfaces of said container forces contained viscous fluid through the lateral port to fill the fluid passageway and end member recess and be blown through the orifice by the air stream flowing toward the forward end of said body.

* * * * *